United States Patent [19]

Vera

[11] 4,226,696

[45] Oct. 7, 1980

[54] ELECTROLYSIS FOIL

[76] Inventor: Paul J. Vera, Galgenberg 52 App. 7, 9209 Serskamp, Belgium

[21] Appl. No.: 44,715

[22] Filed: Jun. 1, 1979

[30] Foreign Application Priority Data

Jun. 2, 1978 [BE] Belgium ..... 57029

[51] Int. Cl.[3] ..... C25D 17/14; C25D 5/02; C25D 9/06

[52] U.S. Cl. ..... 204/290 R; 204/224 R; 204/290 F; 204/284; 204/286; 204/DIG. 10

[58] Field of Search ..... 204/290 R, 290 F, 224 R, 204/284, 286, DIG. 10

[56] References Cited

U.S. PATENT DOCUMENTS

| | | | |
|---|---|---|---|
| 2,750,332 | 6/1956 | Miller | 204/15 |
| 2,798,849 | 7/1957 | Lindsay | 204/224 R |
| 3,751,343 | 8/1973 | Macula et al. | 204/15 |
| 3,963,588 | 6/1976 | Glenn | 204/16 |

FOREIGN PATENT DOCUMENTS

| | | | |
|---|---|---|---|
| 1147730 | 11/1957 | France | 204/224 R |
| 49-21220 | 5/1974 | Japan | 204/224 R |
| 403524 | 10/1973 | U.S.S.R. | 204/224 R |

*Primary Examiner*—F. C. Edmundson
*Attorney, Agent, or Firm*—Bacon & Thomas

[57] ABSTRACT

Electrolysis foil, characterized in that it comprises substantially a sheet or foil of flexible metal with which is suitably bonded a layer of moisture absorbing material, the whole surface of said sheet of flexible material being provided with a large number of small holes.

1 Claim, 2 Drawing Figures

ELECTROLYSIS FOIL

This invention relates to an electrolysis foil, in other words a foil wich may be used as an anode or a cathode when carrying out an electrolysis.

The purpose of such electrolysis foil is to be used in all the circumstances involving pieces which either are too large to be immersed into a bath or are disassembled with difficulty or still require too much time to be disassembled and assembled.

Another object of such electrolysis foil according to the invention is to be used with pieces wherein an electrolysis must be only carried out locally without protecting the portions not being treated.

Still another object of the electrolysis foil according to the invention is to allow its use for treating as well flat surfaces as surfaces with irregularities, it being possible to treat efficiently and accurately even sharp angles formed between these irregularities.

The electrolysis foil according to the invention is substantially characterized in that it comprises a sheet or a foil of flexible metal with which is suitably bonded a layer of a moisture absorbing material, the whole surface of said sheet of flexible material being provided with a large number of small holes.

In order to make more clearly apparent the characteristics of this invention, such electrolysis foil will be described hereafter by way of example and without any limitation, reference being made of the enclosed drawings in which.

Figure 1:
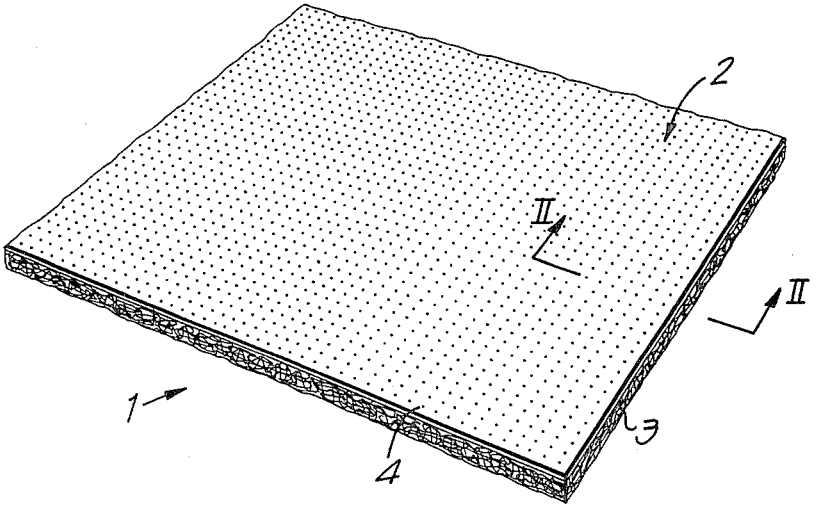
FIG. 1 is a partial perspective view of an electrolysis foil according to the invention.

As shown in the enclosed drawings, the electrolysis foil 1 comprises substantially a sheet of flexible material or foil 2 on which is secured a layer of a moisture absorbing material 3, said layer 3 being suitably bonded with foil 2 so that the electrolysis is not at all inhibited.

In addition, according to the invention, the foil 2 is provided with a large number of small holes 4 along which the gases formed during the electrolysis may be evolved.

Figure 2:
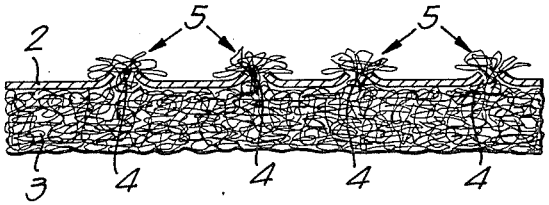
FIG. 2 shows, on an enlarged scale, a cross-section taken on the line II—II of FIG. 1.

In a preferred embodiment, the foil 2 will be an aluminium foil, whereas the layer 3 will be a felt layer, said felt layer 3 being secured with the foil 2 through a so-called "needling" with a needling-machine known per se, so that during the "needling" operation, a portion 5 of the material of the felt 3 will be stitched through the foil 2 as represented in FIG. 2, thereby securing the layer 3 with the foil 2, on one hand, while automatically forming the said holes 4, on the other hand.

When it is necessary, e.g. to remove impurities, grease, metal precipitates and the like which form portion of an element or the like, it is sufficient to dispose the electrolysis foil according to the invention with the layer 3 in an electrically conducting liquid, more particularly an electrolyte and still more particularly, e.g. phosphoric acid, an electrode being then assembled on the object itself, on one hand, and with the aluminium foil 2, on the other hand, so that the dirt and similar material which must be removed from the object being cleaned, are precipitated on the aluminium foil 2.

As it is known, during such electrolysis, there are formed determined gases which, as already mentioned, may be readily evolved through the said small holes 4.

Thus, it is apparent that there is thereby obtained an electrolysis foil 1 permitting one to very readily treat entirely or locally irregular pieces of any size without disassembling or immerging them in a bath.

It is also apparent that such foil may be thus made in any dimension and can be cut to suitable dimensions and shapes for any determined application.

What I claim is:

1. An electrolysis foil, comprising a sheet or foil of flexible aluminum with which is suitably bonded a layer of moister absorbing felt material, the whole surface of said sheet of flexible material being provided with a large number of small holes, the layer of moisture absorbing felt material being bonded with the foil of flexible metal by means of "needling" wherein some of said felt material extends through said holes.

* * * * *